US006227284B1

(12) United States Patent
Cannon

(10) Patent No.: US 6,227,284 B1
(45) Date of Patent: May 8, 2001

(54) HAIR SCULPTURED JEWELRY PIECE AND ITS METHOD OF MANUFACTURE

(76) Inventor: Don S. Cannon, 2460 E. 7600 S., Salt Lake City, UT (US) 84121

( * ) Notice: Subject to any disclaimer, the term of this patent is extended or adjusted under 35 U.S.C. 154(b) by 0 days.

(21) Appl. No.: 09/103,191

(22) Filed: Jun. 23, 1998

(51) Int. Cl.[7] ..... B22C 9/04
(52) U.S. Cl. ..... 164/516; 194/35
(58) Field of Search ..... 63/15, 33, 34, 63/36; 164/516, 35, 45, 246

(56) References Cited

U.S. PATENT DOCUMENTS

| | | | | |
|---|---|---|---|---|
| 56,618 | * | 7/1866 | Sauter | 63/15 |
| D. 89,240 | * | 2/1933 | Kagan | 63/15 X |
| 728,827 | * | 5/1903 | Anthony | 63/15 |
| 1,415,233 | * | 5/1922 | Fahrenwald | 63/15 X |
| 1,656,807 | * | 1/1928 | Zindel | 63/15 |
| 2,124,871 | | 7/1938 | Beal . | |
| 2,341,999 | | 2/1944 | Lennington . | |
| 2,834,052 | | 5/1958 | Hunn . | |
| 4,154,282 | | 5/1979 | Kull . | |
| 4,493,196 | * | 1/1985 | Bogner et al. | 63/15 |
| 4,630,346 | | 12/1986 | Singer . | |
| 4,793,045 | | 12/1988 | Singer . | |
| 4,840,764 | | 6/1989 | Cummins . | |
| 5,208,957 | * | 5/1993 | Hereford | 63/36 X |
| 5,551,503 | * | 9/1996 | Padino | 164/516 |
| 5,594,989 | | 1/1997 | Greve . | |

FOREIGN PATENT DOCUMENTS

| | | | | |
|---|---|---|---|---|
| 908451 | * | 8/1972 | (CA) | 63/15 |
| 59474 | * | 11/1911 | (CH) | 63/15 |
| 945631 | * | 1/1964 | (GB) | 63/15 |

* cited by examiner

*Primary Examiner*—Kuang Y. Lin
(74) *Attorney, Agent, or Firm*—Workman, Nydegger & Seeley

(57) ABSTRACT

An item of jewelry such as a ring, earring, pin, pendant, tie tack, tie clip, tie bar, broach, bracelet, watch or wristwatch, hair pin, barrette, necklace, button, cuff links, or a medallion, and a method for forming the same wherein the item comprises the form of hair in an aesthetically pleasing geometric configuration such as a braid, said item having been cast in a mold formed at least in part by a sample of hair such as human or pet hair. Such an item which is made by investment casting, wherein at least a portion of the investment mold pattern comprises the hair sample. Such an item with a permanent designation of the person who was the source of the hair. Such an item used to adorn a memorial such as a crematory urn, picture frame, or memorial plaque.

5 Claims, 6 Drawing Sheets

HAIR SCULPTURED JEWELRY PIECE AND ITS METHOD OF MANUFACTURE

This patent application is a Divisional patent application of U.S. patent application Ser. No. 09/103,191, entitled "Hair Sculpted Jewelry Piece and its Method of Manufacture," to Don S. Cannon, filed Jun. 23, 1998, which is incorporated herein by reference.

BACKGROUND OF THE INVENTION

1. Field of the Invention

This invention relates to jewelry and ornaments formed by means of casting. More particularly, the present invention relates to a novel method of creating an ornament or piece of jewelry for which the casting mold is formed by an impression from a sample of hair.

2. State of the Art

Investment casting, sometimes called "lost wax" casting, is a well known method of producing intricate cast shapes, and has been widely used by artists, jewelers, dentists, and so forth for many years. Investment castings are generally created by carving, shaping or in some way forming from a wax, resin, or other suitable material a full size three dimensional pattern of the object to be cast. This pattern is enveloped in a mold material which intricately conforms to the shape of the pattern, and is then heated to harden the mold material and to melt or vaporize the wax or resin of the pattern so as to leave behind, within the hardened mold material, a mold having an empty space of the exact shape and size of the pattern. Molten metal or some other desired material is then forced into the mold space to produce the finished part.

One of the great benefits of investment casting is that the mold comprises a single piece that fully encases the pattern. This allows the reproduction of very intricate detail in the casting. Also, because the pattern vaporizes, there is no need to remove it, and thus no need for a two part mold. This avoids the creation of a line or ridge in the casting that frequently forms at the interface of the halves of two part molds.

The inventor has discovered that investment casting may also be performed using objects other than a wax replica as a pattern. Because the investment casting process involves heating the mold material to melt or vaporize the pattern, some objects or substances comprised of organic materials may be cast using the actual object as the pattern. During the heating process the organic material bums or vaporizes away, leaving an empty mold space just as when using a wax pattern. For example, the inventor has successfully made highly detailed castings using actual spiders as the pattern.

The investment casting process is particularly useful for casting jewelry such as pins, pendants, rings, earrings, medallions, etc. Jewelry may function to embody beauty in the form of art or provide a setting for precious stones, or be used as an ornament for picture frames, urns, and other items. Also, jewelry is often a means of symbolizing close relationships or serving as a memento or reminder of a special moment or person.

People frequently desire to have some tangible reminder of a pet or a loved one, particularly when that pet or loved one is deceased. While means exist for preserving all or part of a body, such means are not generally permanent, and keeping such an item as a memento is not generally considered socially acceptable, tasteful, or desirable. Except occasionally in the field of taxidermy, the same is true for items that do not easily decay such as teeth or hair. It would be desirable to have a method of tastefully preserving some tangible reminder of the physical person of a loved one or pet in a form that is considered socially acceptable, and also conveys some indication of the value one places on the memory of that person or pet.

Traditionally, pieces of jewelry such as a locket, pocket watch, pendant, medallion, etc. have been used as tangible, durable mementos of a loved one, particularly when engraved with a meaningful message. Frequently a photograph, and in some cases, a lock of a person's hair is attached to or enclosed within such pieces of jewelry as a reminder. The piece of jewelry thus has sentimental value as a reminder of the person, and may have significant monetary value as well. However, the photo or lock of hair will both eventually deteriorate, possibly leaving a piece of jewelry that has lost a large portion of its emotional value. It would be desirable to have a method of creating jewelry or an ornament of some kind that incorporates a physical reminder of a person such as hair in a durable permanent form that may become part of a piece of valuable jewelry, or may be attached to a picture frame, cremation urn, or other memorial.

OBJECTS AND SUMMARY OF THE INVENTION

It is therefore an object of the present invention to provide an item of jewelry and a method of producing the same, wherein the jewelry comprises the form of hair, such as human hair, in an aesthetically pleasing geometric configuration, said item having been cast in a mold formed from a sample of actual hair.

It is another object of this invention to produce an item of jewelry and a method for its production in which the jewelry is made by investment casting wherein the mold pattern comprises actual hair in an aesthetically pleasing geometric configuration.

It is another object of this invention to produce an item of jewelry comprising the form of human hair which includes an engraved identification of the person from whom the hair sample was obtained.

The above and other objects are realized in an item of jewelry comprising the form of hair, such as human hair, in an aesthetically pleasing geometric configuration, said item having been cast in a mold formed by a sample of actual hair. The name or other identification of the person from whom the hair came may be engraved or otherwise permanently affixed to the piece of jewelry.

Some of the above objects are also realized in a method of creating a piece of jewelry using hair, such as human hair, comprising the steps of obtaining a sample of hair, arranging the sample in an aesthetically pleasing geometric configuration, and forming an impression of the hair sample in a permanent representation as part of jewelry by an investment casting process wherein the sample of hair is consumed in the casting process.

Other objects and features of the present invention will be apparent to those skilled in the art, based on the following description, taken in combination with the accompanying drawings.

DETAILED DESCRIPTION OF THE PREFERRED EMBODIMENT

Figure 1:
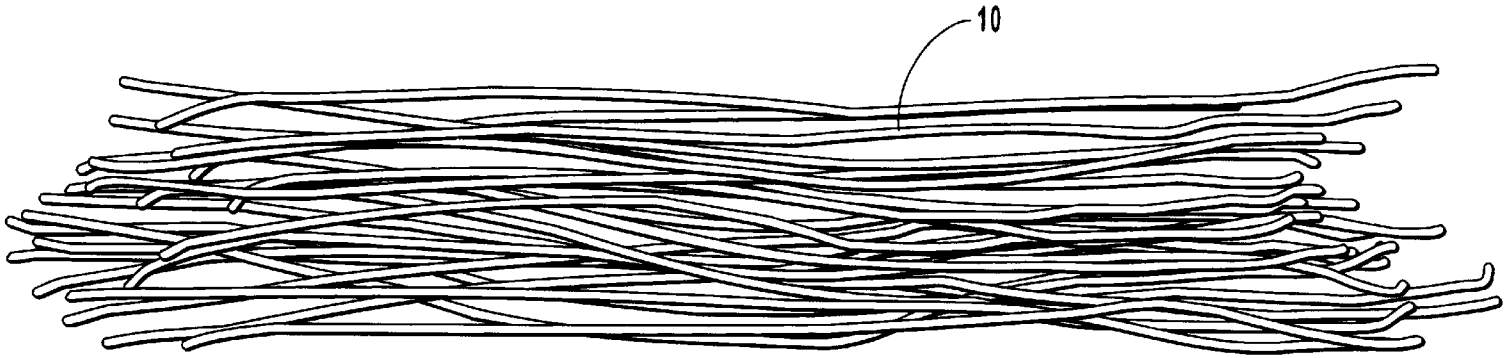
FIG. 1 depicts a sample of hair gathered together ready to be used for the present invention.

Referring now to the drawings:

FIG. 1 depicts a sample of hair strands 10 gathered together ready to be used for the present invention. The hair strands 10 should preferably be of approximately the same length, but in any case should be at least as long as the intended bundle. In the preferred embodiment, the bundle should comprise from approximately 70 to 120 strands of hair, and the strands should be approximately 1.75 inches long or longer. Fewer strands may be used, but will tend to make unsatisfactory braids. More strands will tend to be difficult to twist or braid. In one embodiment, hair shorter than 1.75 inches long is used.

Figure 7:
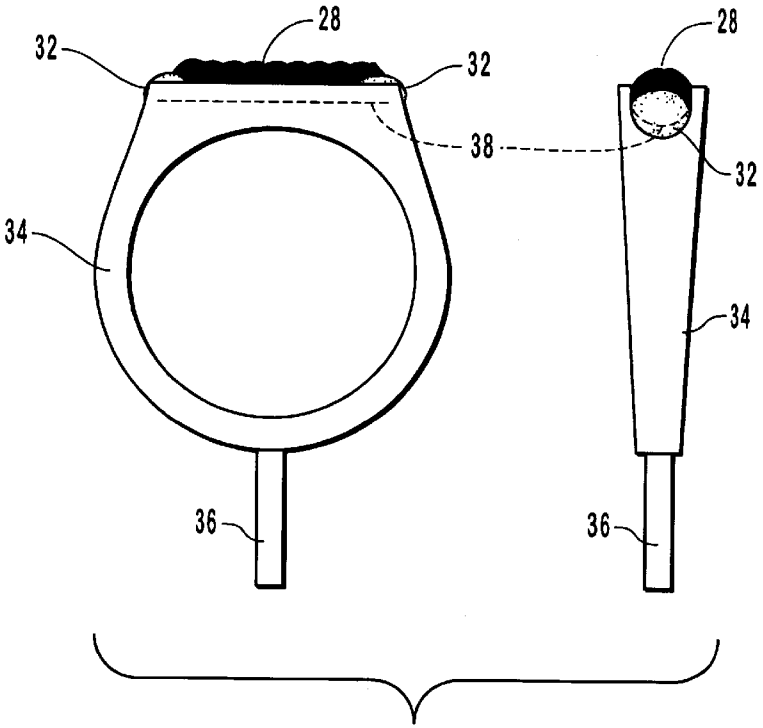
FIG. 7 shows the braid and extruded channel mounted onto a jewelry pattern formed of wax material.

If it is not desired to arrange the hair in a twisted or braided configuration, the hair at this point may be arranged into any desired geometric configuration, and fixed in that configuration by any means that will not hide the texture of the hair, and will allow the hair to impress the mold material without allowing mold material to adversely seep between hair strands. Products generally known as "superglue" or similar liquid adhesives that are relatively non-viscous may serve to fix the hair in this manner. The hair may then be attached to a wax jewelry pattern as depicted in FIG. 7, and the process followed from that point, or the hair form may be attached to a wax sprue and cast individually.

Figure 2:
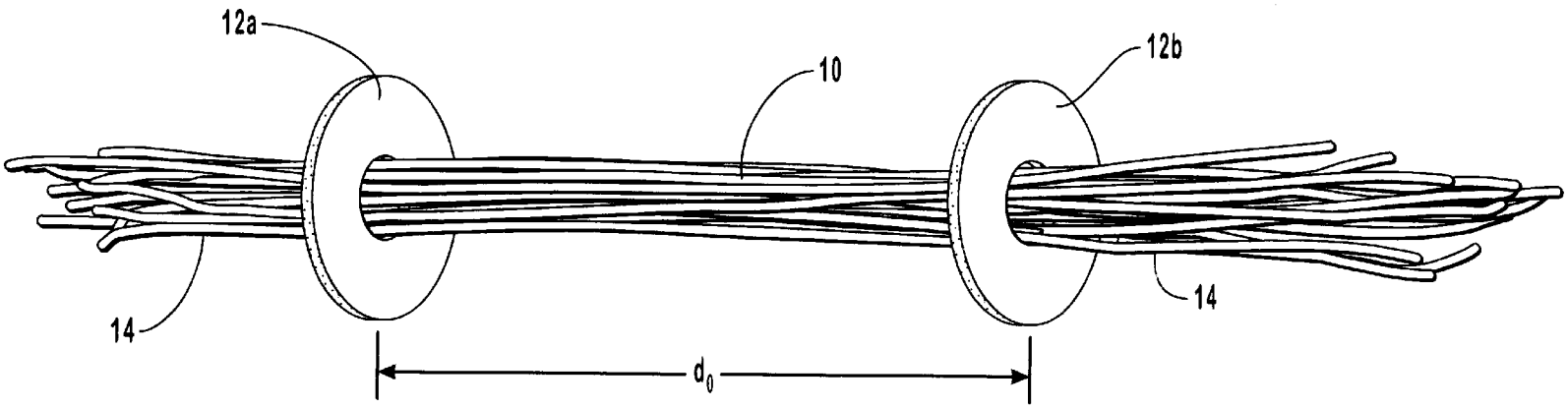
FIG. 2 shows the sample of hair gathered in a bundle with opposite ends secured.

FIG. 2 shows the sample of hair 10 gathered in a bundle with the hair strands roughly parallel and opposite ends secured tightly together an appropriate distance $d_0$ apart, leaving the ends of the hair 14 free. The bundle is preferably comprised of a sufficient number of hair strands to form a bundle of approximately 1/16 in. diameter when the hair is tightly bundled, and the preferred length $d_0$ of the hair bundle is from approximately 1.25 to 2.0 inches. Any satisfactory method of securing the hair bundle will do. In the preferred embodiment the bundle is held together by leather washers 12*a* and 12*b* which comprise central openings of a size adequate to tightly hold the size of bundle chosen.

Figure 3:
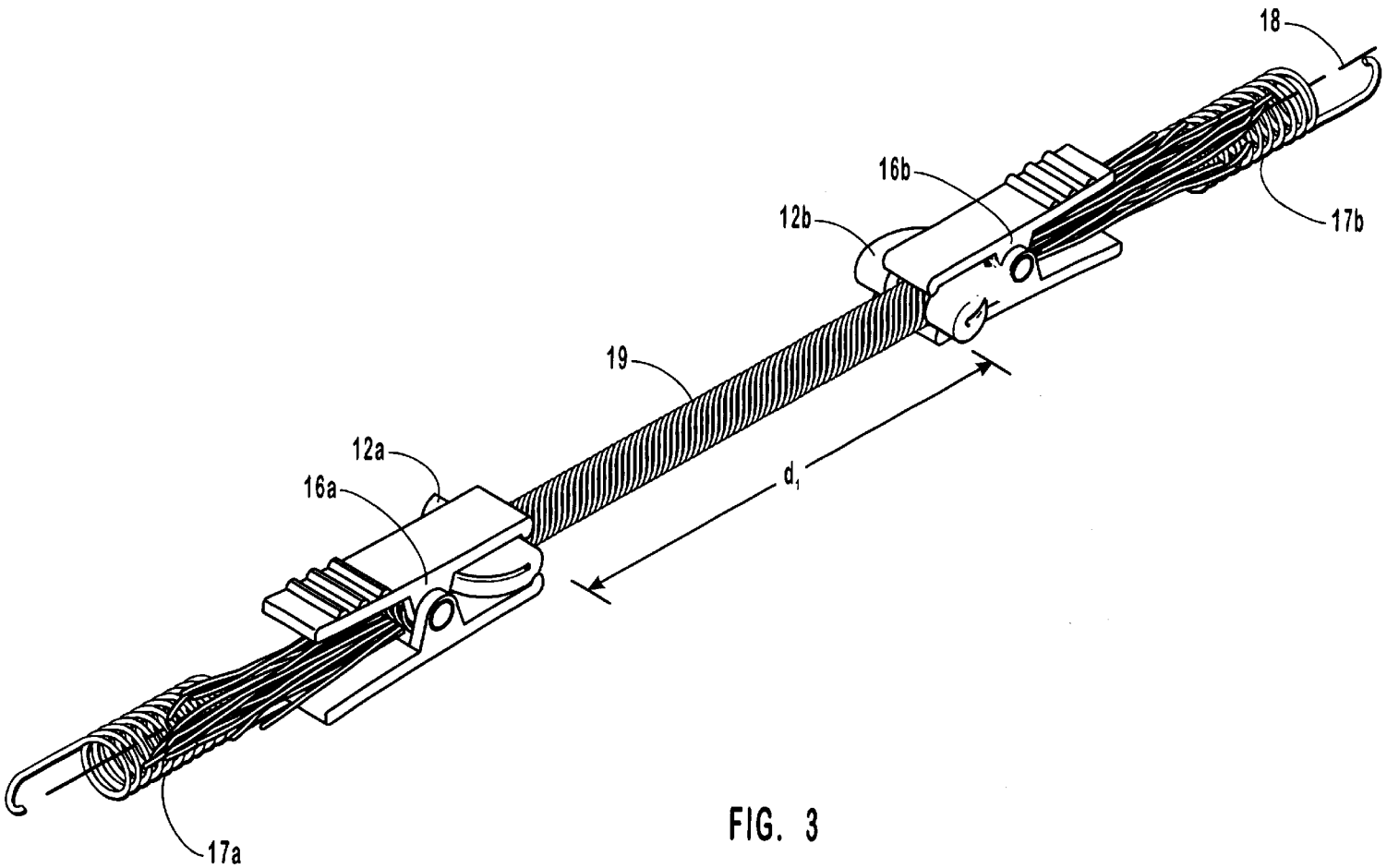
FIG. 3 depicts the hair bundle with its ends clamped and twisted into a cord.

As shown in FIG. 3 the leather washers 12 are securely grasped by clamping means 16*a* and 16*b*. These clamping means may comprise any suitable clamping devices, such as standard alligator clips as shown in FIG. 3. The clamping means are resistively secured opposite each other by stiffly compliant means 17*a* and 17*b* so as to apply a tensile force to the hair bundle. Said stiffly compliant means may comprise springs, and should create a force adequate to hold the hair bundle tightly together, but not so strong as to break the hair strands.

Clip 16*a* is rotationally secured in place, while the opposing clip 16*b* is rotated about the axis 18 of the hair bundle, forming a cord 19 comprised of approximately helically twisted hair strands. As will be readily appreciated, either end 16*a* or 16*b* of the bundle may be secured, and the opposing end rotated. Similarly, the direction in which the bundle is rotated about axis 18 does not matter. It will also be readily appreciated that the twisting procedure causes the hair bundle to shorten, drawing the clamping means 16 toward each other against the force of the stiffly compliant means 17, making the length $d_1$ of the cord 19 less than the original length $d_0$ of the hair bundle 10. Care must be taken to twist the cord 19 an appropriate amount. If it is twisted too tightly, the cord will tend to kink. However, to produce a satisfactory and serviceable casting the cord must be twisted tightly enough so that mold material cannot adversely seep between the strands of the cord later in the process.

The cord 19 may contain some broken, stray hair fibers that diverge from its body. This will not prevent a serviceable casting, and from an aesthetic standpoint may be desirable to help show the texture of the hair and to make it more obvious that the finished casting was created from real hair.

Figure 4:
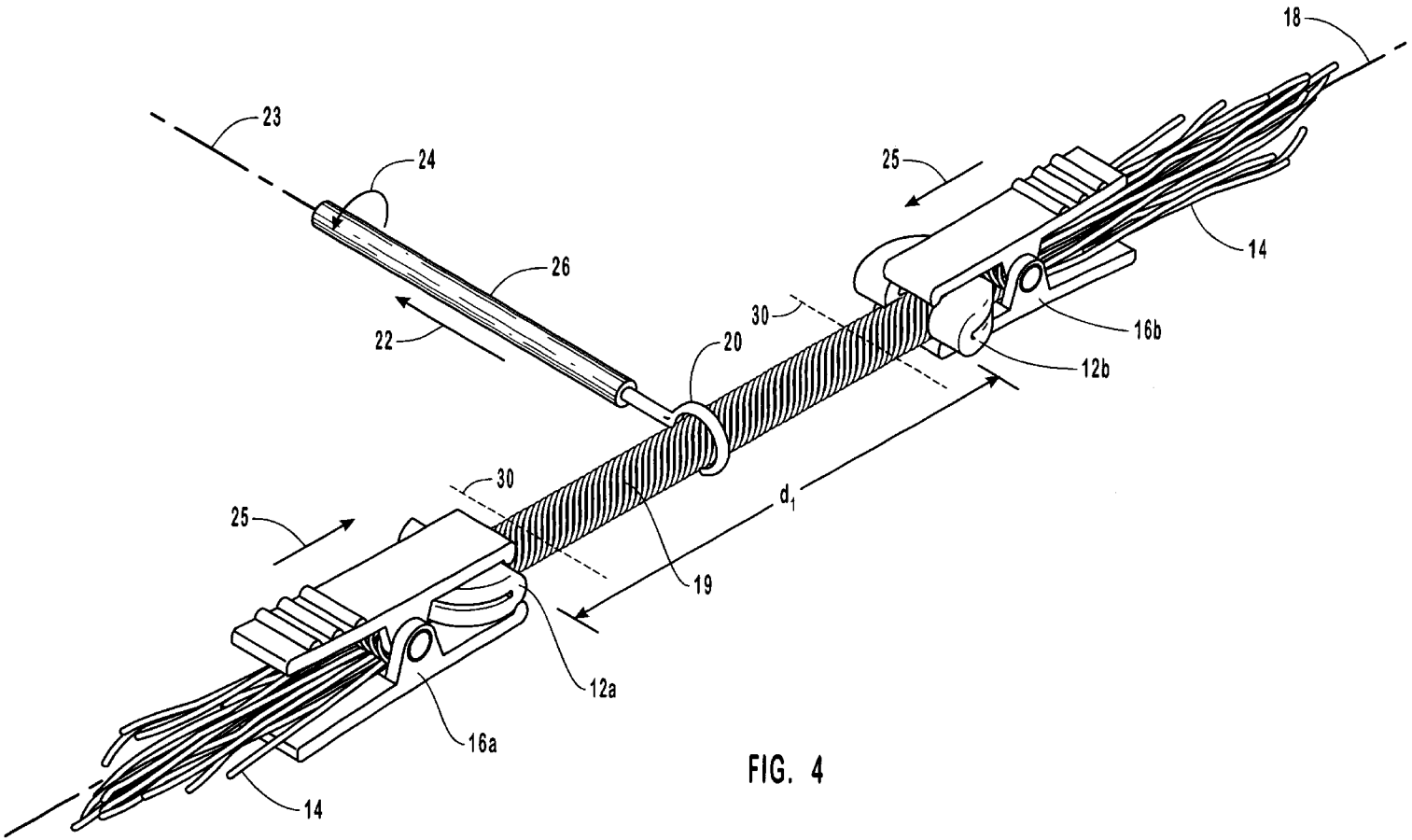
FIG. 4 shows the cord grabbed by a hook which will pull and twist it into a braid.
Figure 6:
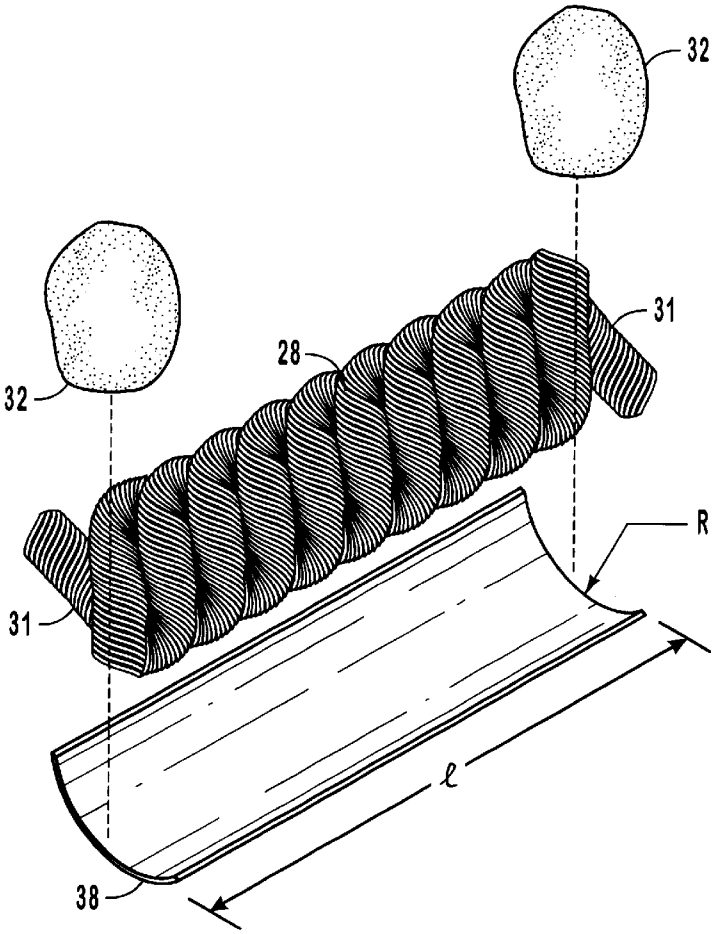
FIG. 6 shows an exploded view of the braid cut to size and being mounted on an extruded wax channel.

FIG. 4 shows the cord 19 ready to be braided. If braiding is not desired, the cord may be fixed in its twisted configuration, cut to length, and used to create a mold by any means that, as noted above, will fix it in the desired geometric configuration, that will not hide the texture of the hair, and that will allow the hair to impress the mold material without allowing the mold material to seep between hair strands. As noted, "superglue" or similar strong, relatively non-viscous adhesive will serve to fix the hair in this manner. The cord may then be cut along lines 30 to some desired length, fixed to a wax channel, sprue, or jewelry pattern as depicted in FIGS. 6 and 7, and the process followed from that point.

To begin braiding, both clamping means 16 are rotationally secured, and the cord 19 is hooked by a hook 20 at a point approximately midway between the clamping means. The hook 20 is pulled by a pulling means 26, such as a rod or spring, in a direction 22 along an axis 23 that is perpendicular to the axis 18 of the cord 19, and is simultaneously rotated in the direction of arrow 24 about the axis 23 of the pulling means. This procedure will draw the clamping means 16 toward each other against the stiffly compliant means 17 in the direction of arrows 25, and will cause the cord 19 to twist about itself, creating a two-cord braid 28. As with the original twisting operation, care must be taken to not to braid too tightly. If the cord is braided too tightly, it will tend to kink. However, it must be braided tightly enough to prevent mold material from seeping between the cords.

As noted above, the twisted hair bundle need not be braided to be used in the method of this invention. It will also be appreciated that cords may be braided in other ways in addition to the two-cord braid depicted in FIGS. 4 and 5. Any method of braiding, such as braiding three cords or four cords or more, and any braiding apparatus now know or later conceived may be employed to create the desired hair configuration in accordance with this invention.

Figure 5:
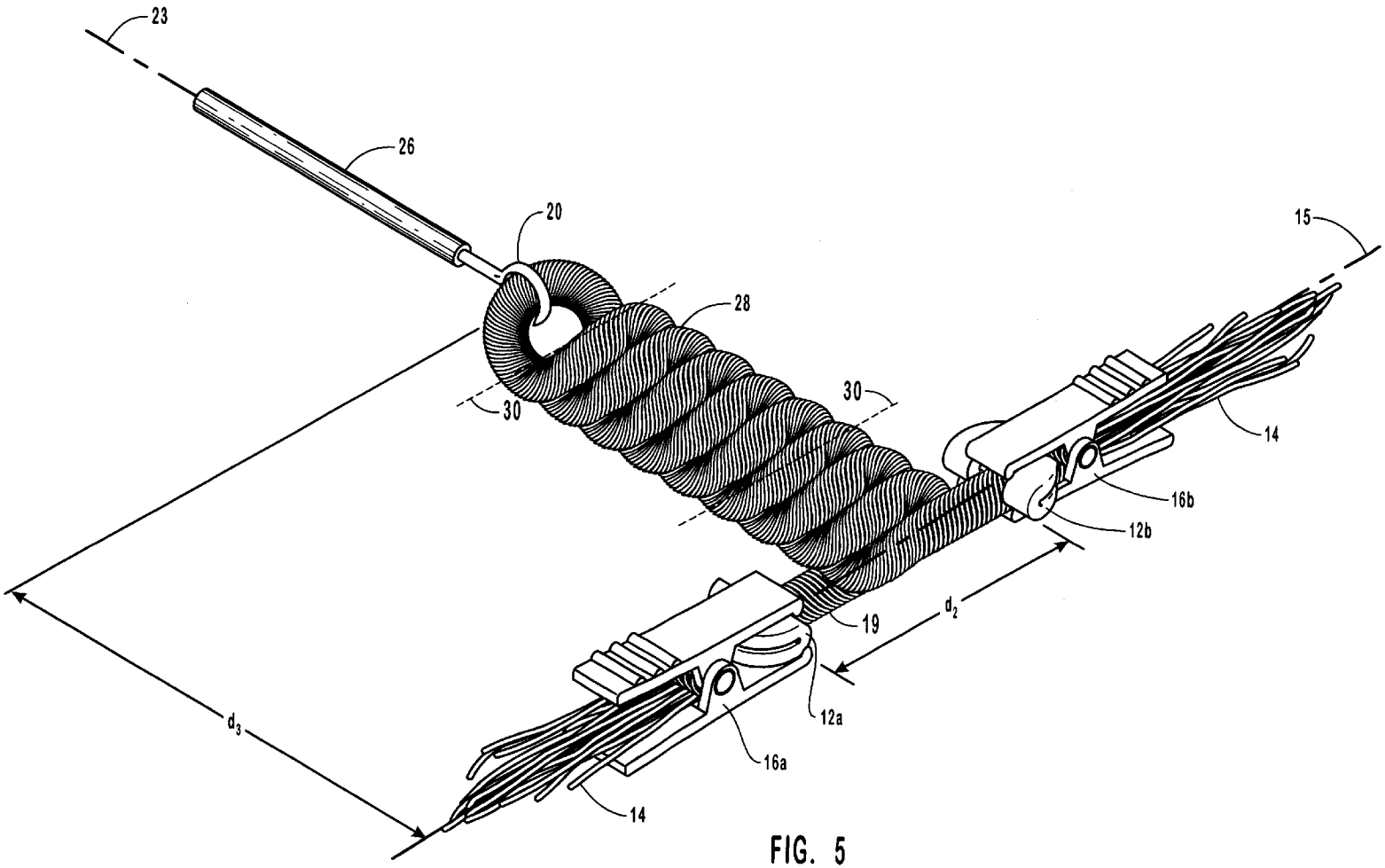
FIG. 5 shows the braid ready to be cut and mounted.

FIG. 5 shows the braid 28 ready to be cut and mounted. At the end of the braiding operation, the braid 28 will have a length $d_3$ that is less than half of the prior length $d_1$ of the cord, and the clamping means 16 will be separated by a distance $d_2$ that is significantly smaller than distance $d_1$ due to the braiding.

The braid is fixed in its twisted configuration by some adhesive such as "superglue" that, as noted above, will fix the hair in its desired geometric configuration, will not hide the texture of the hair, and will allow the braid to impress the mold material without allowing the mold material to seep between braid cords. The braid 28 is then cut along lines 30 creating a segment of some desired length. As with the individual cords, as noted above, the braid may contain some broken, stray hair fibers that diverge from the body of the braid. This will not prevent a serviceable casting, and from an aesthetic standpoint may be desirable to help show the texture of the hair and to make it more obvious that the finished casting was created from real hair.

FIG. 6 shows an exploded view of the cut braid segment 28 in the process of being mounted on a base 38. The base 38 comprises a channel of a length L which approximately matches the length of the braid segment 28, and has a radius R that is complementary to the curvature of the braid 28 in cross-section. This channel is made of wax, resin, or other material suitable for making a pattern for a lost wax casting, and is typically formed by an extrusion process. The ends 31 of the braid 28 or other hair piece is normally affixed to the base 38 by small daubs of highly adhesive wax 32, frequently referred to as "sticky wax," applied at each end 31 of the segment, or by other suitable adhesive means. It will be appreciated that the base 38 need not take the form of a channel, and may be formed in any configuration required by the hair bundle and the intended jewelry piece, depending on the size and shape of the bundle or hair arrangement, whether it is braided or not, and the number of strands comprising the braid. It will also be appreciated that the hair piece may be attached directly to a wax jewelry form, and need not be attached to a channel or base. However, the additional base piece is often useful for handling purposes.

FIG. 7 shows front and side views of the braid and base mounted onto a jewelry pattern formed of wax material. The braid 28 and mounting channel 38 are incorporated into a pattern 34 that, like the base 38, is comprised of the same type of material as the base 38, being wax or other material suitable for a pattern for lost wax casting. The pattern provides the ornamental shape desired to be incorporated into the jewelry in addition to the shape and style of the hair braid, and as shown here is in the form of a ring. It will be appreciated that the jewelry pattern may form other types of jewelry or ornaments such as pins, broaches, pendents, medallions, etc., and may take an infinite variety of ornamental shapes and styles as desired. Furthermore, it will be appreciated that in accordance with the present invention the hair sample and its mounting base may be cast alone, without mounting onto a jewelry pattern of any kind. This procedure is useful when it is desired to create a jewelry piece or ornament in which the hair sculptured pattern is formed of a different material than the jewelry piece or other item on which it is mounted. For example, one could create a silver or platinum hair sculptured piece mounted on a gold ring, pendant, picture frame, or crematory urn. Alternatively, one could in accordance with this invention create a gold hair sculptured piece or medallion mounted on a silver crematory urn or picture frame. It will be appreciated that these are just a few of the many possible variations and embodiments of the present invention.

The braid 28 and base channel 38 are affixed to the pattern 34 by means of small daubs of highly adhesive wax 32 applied at each end 31 of the segment, or by other suitable adhesive means. The jewelry pattern also comprises a sprue 36 that is integrally connected with the pattern 34 and is made of the same pattern material. The sprue 36 is of a cross-section and length that will enable it to communicate with the exterior surface of the mold material when the pattern 34 is fully encased, and that when melted will leave a passageway in the mold material that communicates between the mold space and the exterior of the casting ring, and is of a size suitable for passage of the liquid casting material.

Figure 8:
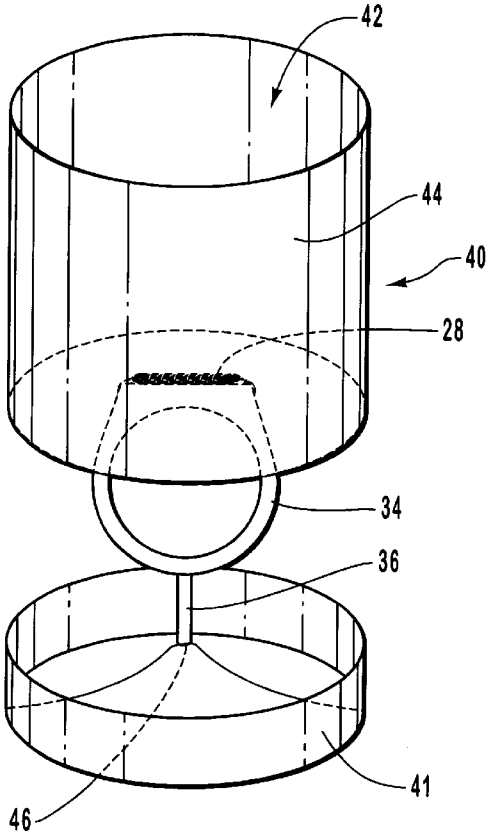
FIG. 8 shows the wax jewelry pattern encased in a casting ring.

FIG. 8 shows the wax jewelry pattern 34 encased in a casting ring, denoted generally at 40, which is designed to be placed in a saddle at the end of the arm of a typical centrifugal casting machine such as is well known in the art. The casting ring 40 typically comprises a cylinder 44 that is open on both ends, and a cone shaped base 41. When the wax jewelry pattern 34 is complete, with the hair sample in place, it is mounted on the base 41 with the sprue 36 downward, the bottom end 46 of the sprue being firmly attached to the center of the base 41, at the apex of the cone shape. The cylinder 44 is then placed over and around the pattern 34 and connected to the base 41 such that the pattern 34 is entirely within the cylinder, but does not touch its sides. This ensures that all portions of the pattern, except the very end of the sprue 46 which is attached to the base 41, will be completely enveloped when the liquid mold material is poured into the top of the cylinder, denoted at 42. Then a suitable liquid mold material is poured into the cylinder. Suitable mold materials include but are not limited to commercially available high heat investment products such as "Beauty-Cast" gypsum investment for low-fusing alloys, manufactured by Whip Mix Corp., and "Cera-Fina" fine grain carbon-free investment, also manufactured by Whip Mix Corp.

Care must be taken to ensure that the mold material 42 envelopes all surfaces and details of the pattern 34, and that all bubbles and air pockets are removed from the liquid casting ring. This may be accomplished through vibration of the casting ring during the process of pouring the liquid mold material. After the pattern is thus encased in the mold material, the end of the sprue 46, having been attached to the center of the cone shaped base 41, will form the apex of a funnel once the investment material has solidified and the base 41 is removed.

To prepare for casting, after the mold material is in place the casting ring 40 is placed in an oven and heated to a suitable temperature. The temperature and duration of heating required depend on the particular mold material and the temperature necessary to vaporize the wax pattern and hair. Additionally, the mold must be heated to at least the temperature of the molten material to be cast. This temperature is maintained during the casting process so that the molten material will not cool and solidify prematurely upon its introduction into the mold. Typically, casting rings of this sort are heated in the range of from 800° F. to 1400° F. depending on the type of casting material to be used. The heating process causes the liquid mold material 42 to solidify and cure by driving all moisture out of the liquid mold material, and simultaneously causes the wax pattern, sprue, and hair sample to vaporize. This process leaves a hard but somewhat porous casting ring 40 with an empty internal mold space in the exact shape of the pattern 34 and connected hair sample 28, and leaves a passageway in place of the sprue 36 which communicates between the internal mold space and the center of the funnel formed by the base 41. What was the end of the sprue 46 is now an opening in the center of the funnel. Importantly, the porosity of the hardened casting ring allows air to be driven out of the mold when the molten metal is introduced.

To cast the piece of jewelry, the casting ring is placed in a centrifugal caster, and a suitable liquid casting material is forced by centrifugal force into the opening 46 of the passageway formed by the sprue 36, and passes into the mold space left by the pattern 34. Suitable casting materials include all types of precious metals and alloys typically used for jewelry, in molten form, including but not limited to gold, silver, copper, platinum, and so forth. It will be apparent that castings may also be made following the method of this invention from other materials including non-metals.

Figure 9:
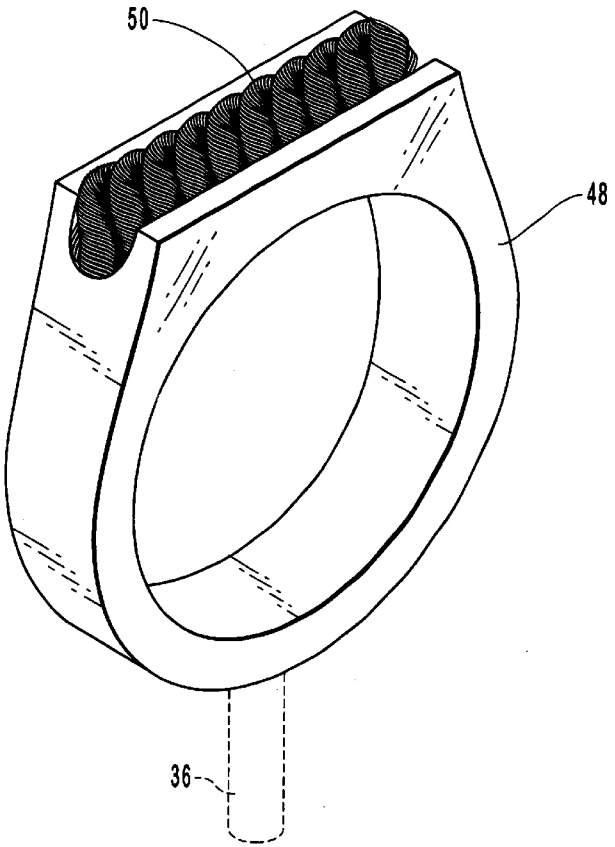
FIG. 9 shows the finished piece of jewelry with the braided hair pattern.

Once the casting has solidified, the casting ring is stripped away, and the casting is thoroughly cleaned and polished as is typical of cast jewelry. The sprue 36, now comprised of the solidified casting material, unwanted burrs, including globs formed where the daubs of sticky wax were placed, and other defects may be removed by grinding, polishing, and other suitable processes known in the art. FIG. 9 shows the finished casting 48 with the braided hair pattern 50. The jewelry piece is now ready to be worn and displayed with the decorative pattern from actual hair.

In one embodiment of the present invention, the item of jewelry formed is selected from the group consisting of a ring, earring, pin, pendant, tie tack, tie clip, tie bar, broach, bracelet, watch or wristwatch, hair pin, barrette, necklace, button, and cuff links.

It is to be understood that the above-described methods are only illustrative of the application of the principles of the present invention. Numerous modifications and alternative methods may be devised by those skilled in the art without departing from the spirit and scope of the present invention, and the appended claims are intended to cover such modifications.

What is claimed is:

1. A method of preparing an item of jewelry having a pattern that comprises the form of hair, wherein the item of jewelry is suitable for use as a keepsake, memento, or other tangible remainder of emotional significance, such as of a person or pet, the method comprising:

obtaining a sample of hair that includes a plurality of strands of hair;

arranging said sample of hair in a bundle with the strands approximately parallel and in close proximity to each other, said bundle having a first end and a second end;

grasping the first end of said bundle of hair in a first clamp means and grasping the second end of said bundle of hair in a second clamp means;

rotating said second clamp means so as to twist the bundle of hair about its longitudinal axis into the form of a cord, said twisting being sufficient to prevent mold material from seeping between the strands of hair during an investment casting process;

hooking the cord perpendicularly approximately at its midpoint with a hooking means having a longitudinal axis so as to bisect the cord into a first half and a second half;

applying a pulling force to said hooking means along its longitudinal axis in a direction perpendicular to said cord and simultaneously rotating said hooking means at least once about its longitudinal axis so as to twist the first half of the cord about the second half of the cord forming a braid, the force of said pulling and twisting of the hooking means drawing the first clamp means and the second clamp means toward each other;

forming an impression of the braid in a permanent representation by an investment casting process, the permanent representation accurately reproducing the generally fine texture ordinarily associated with individual strands of hair, wherein the hair sample is consumed in the casting process; and casting an item of jewelry using the permanent representation, the item of jewelry accurately reflecting the generally fine texture of the hair sample that was reproduced in forming the impression.

2. A method as recited in claim 1, further comprising mounting said sample of hair on a material such that the collective hair sample and material are suitable for investment casting, wherein forming an impression of the hair sample includes forming an impression of the collective hair sample and material.

3. A method as recited in claim 2, wherein the material on which the hair is mounted comprises a wax material.

4. A method as recited in claim 3, wherein the wax material has the shape of an item of jewelry.

5. A method as recited in claim 4, wherein forming an impression of the collective hair sample and material comprises:

mounting the wax material with the sample of hair thereon in a casting ring;

pouring a liquid investment material into the casting ring; and heating the liquid investment material until the wax material and hair are consumed.

* * * * *